US011270878B2

(12) United States Patent
Sasai et al.

(10) Patent No.: US 11,270,878 B2
(45) Date of Patent: Mar. 8, 2022

(54) QUADRUPOLE MASS SPECTROMETER, QUADRUPOLE MASS SPECTROMETRY METHOD, AND PROGRAM STORAGE MEDIUM STORING PROGRAM FOR QUADRUPOLE MASS SPECTROMETER

(71) Applicants: HORIBA STEC, Co., Ltd., Kyoto (JP); HORIBA, Ltd., Kyoto (JP)

(72) Inventors: Kohei Sasai, Kyoto (JP); Kazushi Sasakura, Kyoto (JP); Toshihiro Ikeyama, Kyoto (JP); Takahito Inoue, Kyoto (JP); Hiroshi Uchihara, Kyoto (JP)

(73) Assignees: HORIBA STEC, CO., LTD., Kyoto (JP); HORIBA, LTD., Kyoto (JP)

( * ) Notice: Subject to any disclaimer, the term of this patent is extended or adjusted under 35 U.S.C. 154(b) by 0 days.

(21) Appl. No.: 16/953,946

(22) Filed: Nov. 20, 2020

(65) Prior Publication Data

US 2021/0166932 A1 Jun. 3, 2021

(30) Foreign Application Priority Data

Dec. 2, 2019 (JP) ..... JP2019-218355

(51) Int. Cl.
*H01J 49/42* (2006.01)
*H01J 49/02* (2006.01)

(52) U.S. Cl.
CPC ..... *H01J 49/4215* (2013.01); *H01J 49/022* (2013.01); *H01J 49/025* (2013.01); *H01J 49/4295* (2013.01)

(58) Field of Classification Search
CPC .... H01J 49/022; H01J 49/025; H01J 49/0027; H01J 49/0036; H01J 49/4215; H01J 49/4295
See application file for complete search history.

(56) References Cited

U.S. PATENT DOCUMENTS

2009/0266983 A1* 10/2009 Yamamoto ..... H01J 49/0036 250/287
2013/0015344 A1* 1/2013 Muntean ..... H01J 49/0036 250/282

(Continued)

FOREIGN PATENT DOCUMENTS

JP 5412246 B2 2/2014

*Primary Examiner* — David E Smith
(74) *Attorney, Agent, or Firm* — Greenblum & Bernstein, P.L.C.

(57) ABSTRACT

A quadrupole mass spectrometer includes an ion source that ionizes a sample, a filter unit that includes a quadrupole and separates ions generated from the ion source according to mass, a detector that detects ions passing through the filter unit, a filter voltage controller that controls a filter voltage applied to the quadrupole to switch between a blocking mode in which ions entering the filter unit are not allowed to impinge on the detector and a passing mode in which ions entering the filter unit are allowed to impinge on the detector, the filter voltage including a radio-frequency voltage and a direct-current voltage, a baseline computing unit that computes a baseline based on outputs of the detector in the blocking mode, and an analyzing unit that outputs an analysis result of the sample based on outputs of the detector in the passing mode and the computed baseline.

9 Claims, 7 Drawing Sheets

(56) References Cited

U.S. PATENT DOCUMENTS

| | | | | |
|---|---|---|---|---|
| 2014/0138539 | A1* | 5/2014 | Kou | H01J 49/427 250/283 |
| 2014/0151544 | A1* | 6/2014 | Grothe, Jr. | H01J 49/0031 250/282 |
| 2017/0263426 | A1* | 9/2017 | Hall | H01J 49/0036 |
| 2018/0166262 | A1* | 6/2018 | Moulds | H01J 49/0031 |

* cited by examiner

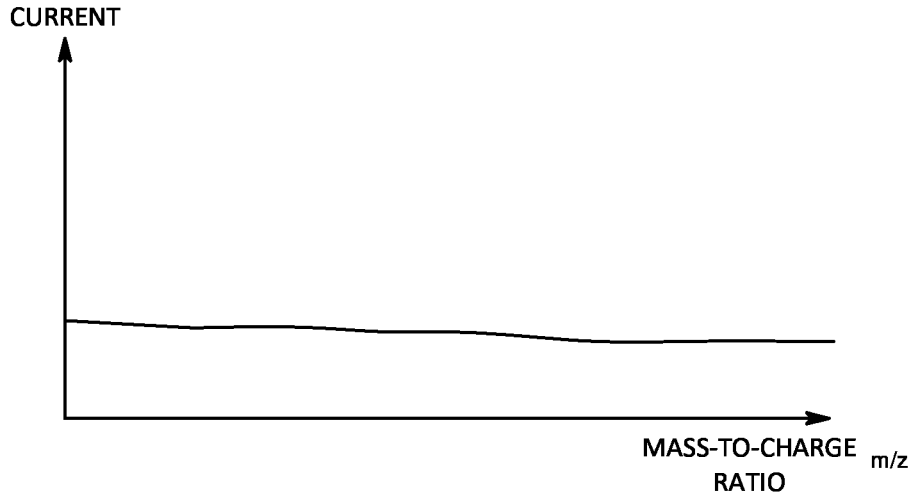
FIG.7A (a)CURRENTS (BASELINE) IN BLOCKING MODE
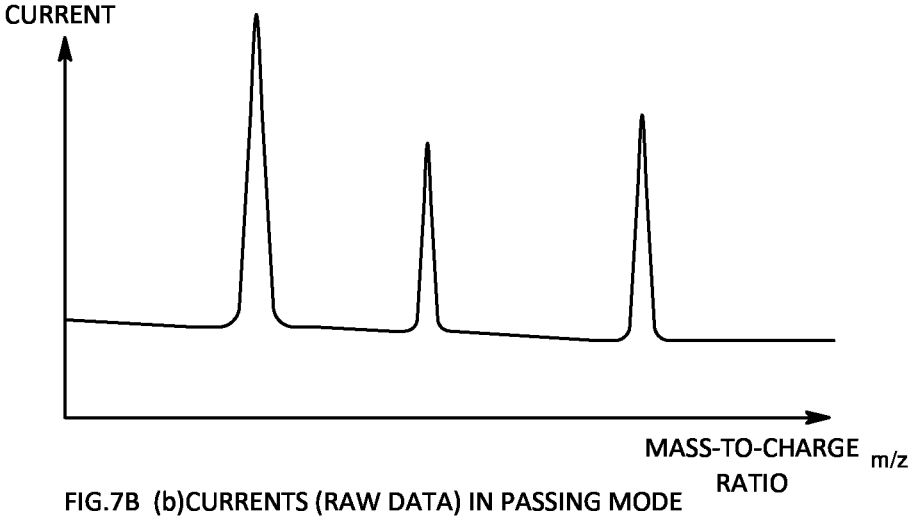
FIG.7B (b)CURRENTS (RAW DATA) IN PASSING MODE
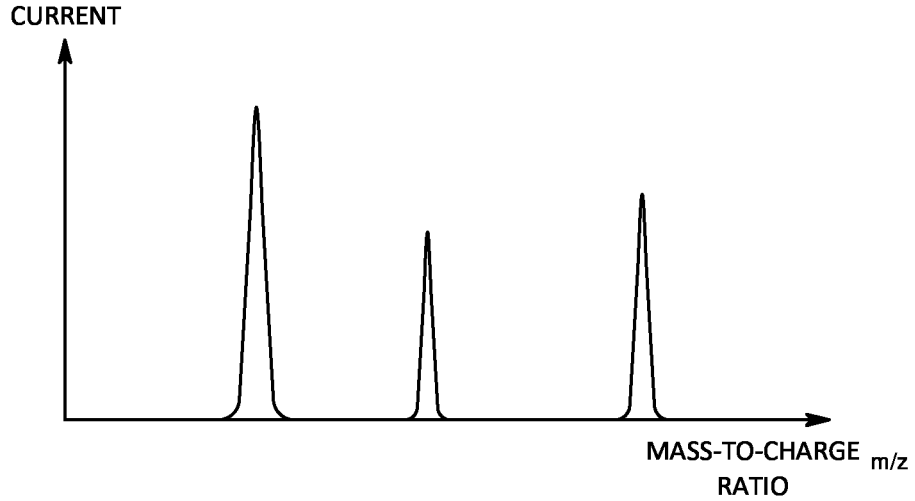
FIG.7C (c)OUTPUT (SUBJECTED TO BASELINE PROCESS) OF ANALYZING UNIT

QUADRUPOLE MASS SPECTROMETER, QUADRUPOLE MASS SPECTROMETRY METHOD, AND PROGRAM STORAGE MEDIUM STORING PROGRAM FOR QUADRUPOLE MASS SPECTROMETER

BACKGROUND OF THE INVENTION

1. Field of the Invention

The present invention relates to a quadrupole mass spectrometer.

2. Description of the Related Art

A quadrupole mass spectrometer includes an ion source that ionizes a sample, a filter unit that includes a quadrupole and separates incoming ions from the ion source according to mass, and a detector that detects ions passing through the filter unit. A filter voltage is applied to the quadrupole and the filter unit functions as a mass filter. The filter voltage is a combination of a radio-frequency (RF) voltage and a direct-current (DC) voltage at a predetermined ratio based on the Mathieu equation. The filter voltage is swept from a lower value to a higher value while the above-described predetermined ratio is maintained, thereby obtaining a mass spectrum of ions through outputs of the detector.

The quadrupole mass spectrometer performs a baseline process to reduce noise caused by neutral molecules from an obtained mass spectrum or correct for offset of the zero point. For example, Japanese Patent No. 5412246 discloses that a passing period during which ions are allowed to impinge on a detector and a blocking period during which ions are not allowed to impinge on the detector are provided, and signals obtained from the detector in the blocking period are subtracted from signals obtained from the detector in the passing period to process a baseline. More specifically, the passing period and the blocking period are achieved by changing the potential of a post-filter disposed downstream of a quadrupole. Another exemplary method of achieving the passing period and the blocking period includes changing the difference in potential between the ion source and the filter unit so that ions generated from the ion source are not allowed to enter the filter unit and are not detected by the detector.

However, if the blocking period is achieved by using any of the above-described methods so that ions are not allowed to impinge on the detector, a high-intensity signal may be generated as an output of the detector, particularly at a small mass-to-charge ratio, such that the intensity of the signal is higher than those at other mass-to-charge ratios. Thus, simply subtracting outputs of the detector in the blocking period from those in the passing period may fail to achieve an appropriate baseline process.

Patent Literature 1: Japanese Patent No. 5412246

SUMMARY OF THE INVENTION

The present invention has been made in consideration of the above-described problem and aims to provide a quadrupole mass spectrometer that achieves an appropriate baseline process by ensuring that ions are not allowed to impinge on a detector.

A first aspect of the present invention provides a quadrupole mass spectrometer including: an ion source configured to ionize a sample; a filter unit including a quadrupole and configured to separate ions generated from the ion source according to mass; a detector configured to detect ions passing through the filter unit; a filter voltage controller configured to control a filter voltage applied to the quadrupole to switch between a blocking mode in which ions entering the filter unit are not allowed to impinge on the detector and a passing mode in which ions entering the filter unit are allowed to impinge on the detector, the filter voltage including a radio-frequency (RF) voltage and a direct-current (DC) voltage; a baseline computing unit configured to compute a baseline based on outputs of the detector in the blocking mode; and an analyzing unit configured to output an analysis result of the sample based on outputs of the detector in the passing mode and the baseline computed by the baseline computing unit.

A second aspect of the present invention provides a quadrupole mass spectrometry method for a quadrupole mass spectrometer that includes an ion source configured to ionize a sample, a filter unit including a quadrupole and configured to separate ions generated from the ion source according to mass, and a detector configured to detect ions passing through the filter unit, the method including: controlling a filter voltage applied to the quadrupole to switch between a blocking mode in which ions entering the filter unit are not allowed to impinge on the detector and a passing mode in which ions entering the filter unit are allowed to impinge on the detector, the filter voltage including an RF voltage and a DC voltage; computing a baseline based on outputs of the detector in the blocking mode; and outputting an analysis result of the sample based on outputs of the detector in the passing mode and the computed baseline.

According to these aspects, the filter voltage controller controls the filter voltage applied to the quadrupole in the blocking mode so that ions are not allowed to impinge on the detector, thus destabilizing oscillation of ions in the filter unit such that the ions traveling through the filter unit strike the quadrupole, or alternatively, changing trajectories of ions such that the ions do not impinge on the detector. This ensures that ions are not allowed to impinge on the detector in the blocking mode. This achieves that ions have no influence on outputs of the detector in the blocking mode, thus obtaining a baseline in which noise caused by, for example, neutrons, or a temperature drift alone appears. Thus, the analyzing unit can obtain an analysis result of the sample subjected to a more appropriate baseline process than in the related art.

To obtain a clear peak for each mass-to-charge ratio from outputs of the detector in the passing mode and block ions from impinging on the detector in the blocking mode, the filter voltage controller may sweep the filter voltage in the passing mode such that the filter voltage passes through at least one stability region that is a set of combinations of RF voltages and DC voltages allowing ions to pass through the filter unit and reach the detector, and may sweep the filter voltage in the blocking mode such that the filter voltage passes outside the at least one stability region.

For an exemplary way of sweeping the filter voltage suitable for mass separation in the passing mode, the at least one stability region may include a plurality of stability regions determined for mass-to-charge ratios of ions, and the filter voltage controller may sweep the filter voltage in the passing mode such that the filter voltage passes through apexes, at each of which the DC voltage is maximum relative to the RF voltage, of the stability regions or portions of the stability regions that are near the apexes.

To block ions in the range of mass-to-charge ratios to be analyzed from impinging on the detector in the blocking mode, the at least one stability region may include a plurality of stability regions determined for mass-to-charge ratios of ions, and the filter voltage controller may sweep the filter voltage in the blocking mode such that the filter voltage passes outside all of the stability regions.

For a specific way of ensuring that ions are not allowed to impinge on the detector in the blocking mode while a voltage sweeping operation corresponding to that in the passing mode is being performed in the blocking mode, a slope of the DC voltage relative to the RF voltage of the filter voltage swept by the filter voltage controller in the blocking mode may be set to be greater than a slope of the DC voltage relative to the RF voltage of the filter voltage swept by the filter voltage controller in the passing mode.

To achieve that a baseline obtained in the blocking mode is reproduced reliably in the passing mode such that there is no difference, except a voltage applied to the quadrupole, between the passing mode and the blocking mode, the quadrupole mass spectrometer may further include an ion injection electrode configured to produce an electric field that extracts ions from the ion source and causes the ions to enter the filter unit, and a voltage applied to the ion injection electrode in the passing mode may be identical to a voltage applied to the ion injection electrode in the blocking mode.

To obtain the same advantages as those of the quadrupole mass spectrometer according to the first aspect of the present invention in an existing quadrupole mass spectrometer by simply updating a program in the existing quadrupole mass spectrometer, the following program may be used. The program is to be used for a quadrupole mass spectrometer that includes an ion source configured to ionize a sample, a filter unit including a quadrupole and configured to separate ions generated from the ion source according to mass, and a detector configured to detect ions passing through the filter unit, and causes a computer to function as: a filter voltage controller configured to control a filter voltage applied to the quadrupole to switch between a blocking mode in which ions entering the filter unit are not allowed to impinge on the detector and a passing mode in which ions entering the filter unit are allowed to impinge on the detector, the filter voltage including an RF voltage and a DC voltage; a baseline computing unit configured to compute a baseline based on outputs of the detector in the blocking mode; and an analyzing unit configured to output an analysis result of the sample based on outputs of the detector in the passing mode and the baseline computed by the baseline computing unit.

This program may be electrically distributed or may be stored in a program storage medium, such as a compact disc (CD), a digital versatile disc (DVD), or a flash memory.

Since the quadrupole mass spectrometer according to the first aspect of the present invention controls the filter voltage applied to the quadrupole in the blocking mode in the above-described manner, it is more reliably possible to block ions from impinging on the detector than in the related art. This significantly reduces the likelihood that an output of unknown cause may appear in an obtained baseline, resulting in improved reliability of the baseline. This leads to a more appropriate result of sample analysis, which is obtained from outputs of the detector in the passing mode and a baseline, than in the related art.

BRIEF DESCRIPTION OF THE DRAWINGS

FIG. 7A is a schematic graph illustrating exemplary outputs of a detector in the blocking mode in the embodiment.

FIG. 7B is a schematic graph illustrating exemplary outputs of the detector in the passing mode in the embodiment.

FIG. 7C is a schematic graph illustrating an exemplary analysis result obtained by an analyzing unit.

DESCRIPTION OF THE PREFERRED EMBODIMENTS

A quadrupole mass spectrometer 100 according to an embodiment of the present invention will be described with reference to FIGS. 1 to 7C.

Figure 1:
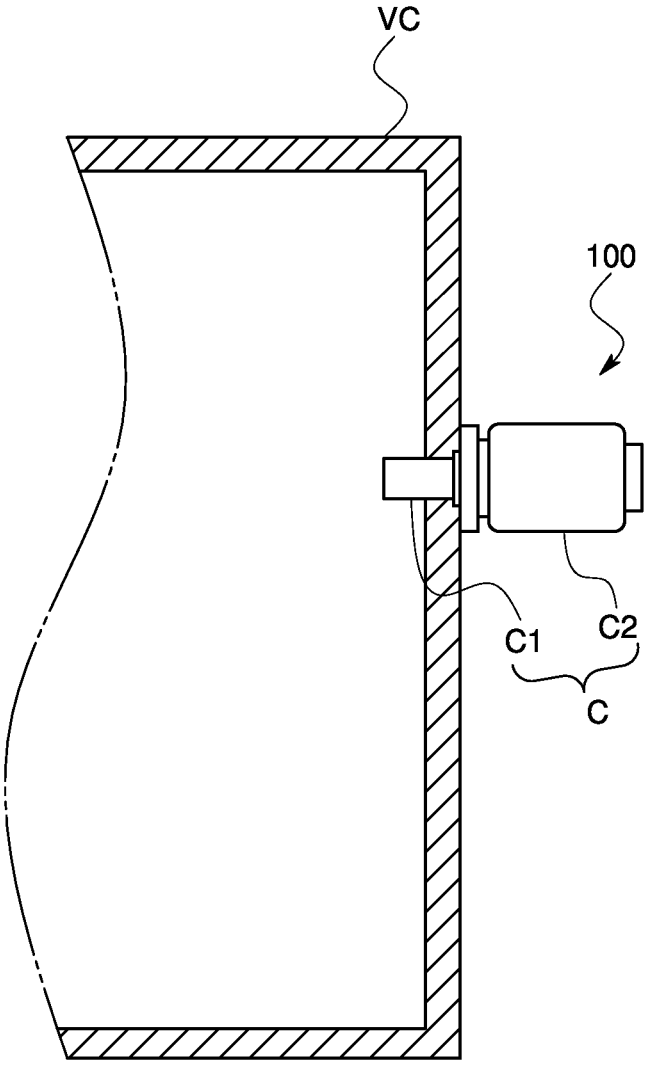
FIG. 1 is a diagram illustrating a quadrupole mass spectrometer according to an embodiment of the present invention attached to a vacuum chamber.

As illustrated in FIG. 1, the quadrupole mass spectrometer 100 according to this embodiment is attached to a vacuum chamber VC, such as a semiconductor processing chamber, and is used as a residual gas analyzer to analyze residual gas in the chamber VC.

Figure 2A:
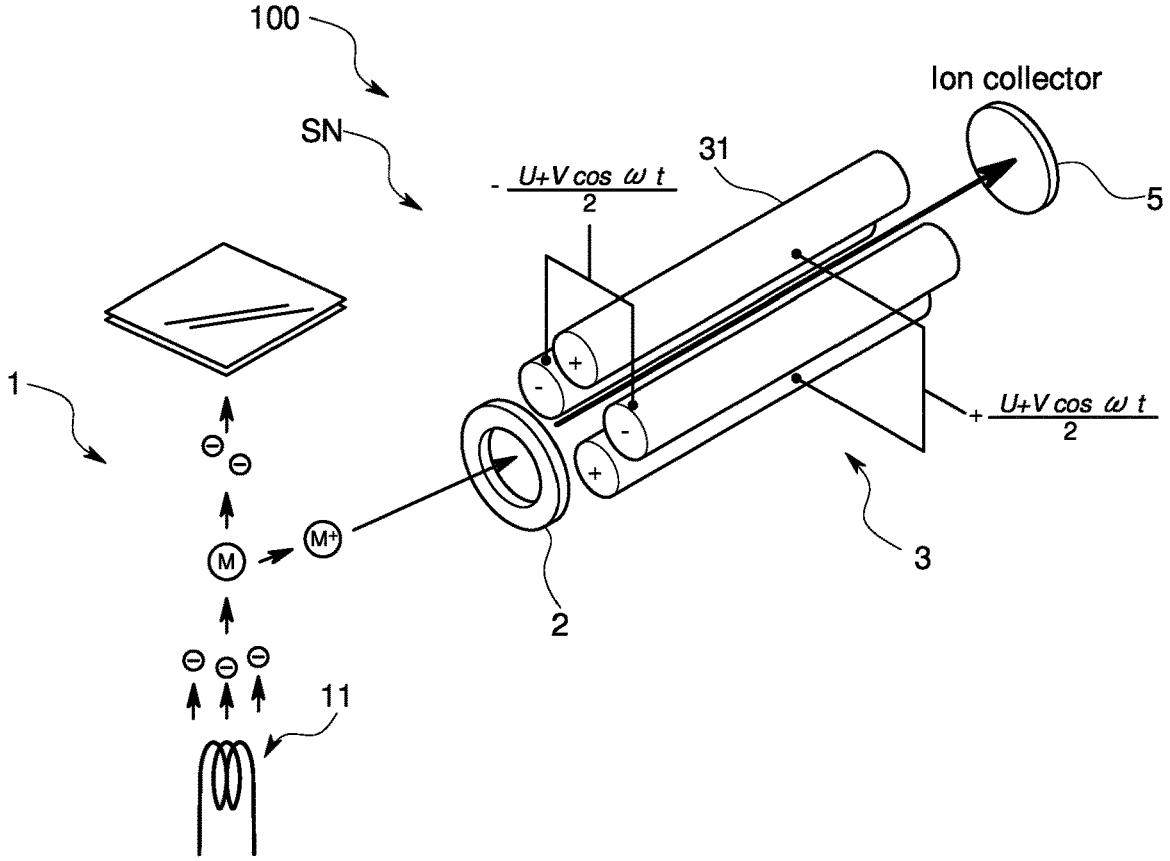
FIG. 2A is a schematic perspective view of an exemplary configuration of the quadrupole mass spectrometer according to the embodiment.

The quadrupole mass spectrometer 100 includes a casing C, a sensor mechanism SN, which is illustrated in FIG. 2A, disposed in the casing C, and a control computing mechanism 6, which is not illustrated in FIGS. 1 and 2A.

As illustrated in FIG. 1, the casing C includes a first cover C1 and a second cover C2. The first cover C1 is attached to the chamber VC such that a distal end face of the first cover C1 is located inside the chamber VC, and accommodates the sensor mechanism SN. The second cover C2 is disposed outside the chamber VC and accommodates the control computing mechanism 6. The distal end face of the first cover C1 located inside the chamber VC has a gas inlet through which gas in the chamber VC is introduced into the sensor mechanism SN.

Figure 3:
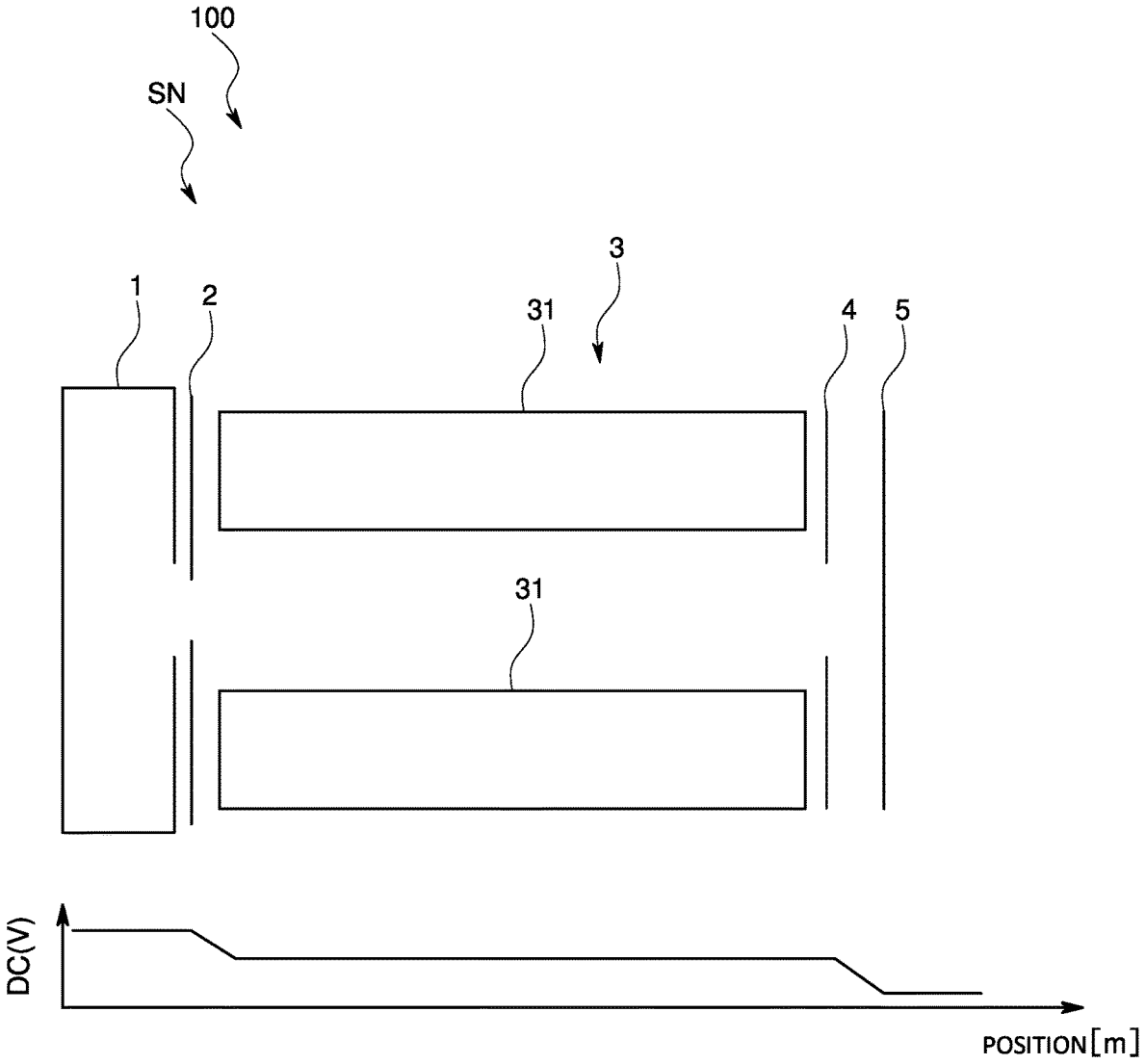
FIG. 3 is a schematic diagram illustrating the configuration of the quadrupole mass spectrometer according to the embodiment and overall potential gradient.

As illustrated in FIGS. 2A and 3, the sensor mechanism SN includes an ion source 1, an extraction electrode 2, a filter unit 3, a detector 5, and a post-filter 4. The ion source 1 ionizes a sample introduced through the gas inlet by electron collision. The extraction electrode 2 extracts ions generated from the ion source 1 to accelerate and focus the extracted ions. The filter unit 3 separates the ions, accelerated and focused by the extraction electrode 2, according to mass-to-charge ratio by using a radio-frequency electric field generated through a quadrupole 31, which includes four cylindrical electrodes. The detector 5 detects ions separated through the filter unit 3 and outputs a current based on the number of detected ions to the control computing mechanism 6. The post-filter 4 is interposed between the filter unit 3 and the detector 5. These components are arranged in a line in a direction in which ions travel.

The sensor mechanism SN in the embodiment operates in either one of at least two modes, a passing mode in which ions are allowed to impinge on the detector 5 and a blocking mode in which ions are not allowed to impinge on the detector 5. Switching between these modes is achieved by changing a filter voltage applied to the quadrupole 31 in the filter unit 3.

In the ion source 1, molecules introduced as a sample from the chamber VC are ionized by electrons emitted from an electron gun 11. The electron gun 11 emits electrons in each of the passing mode and the blocking mode. The ion source 1 is configured to ionize incoming molecules at all times.

Figure 2B:
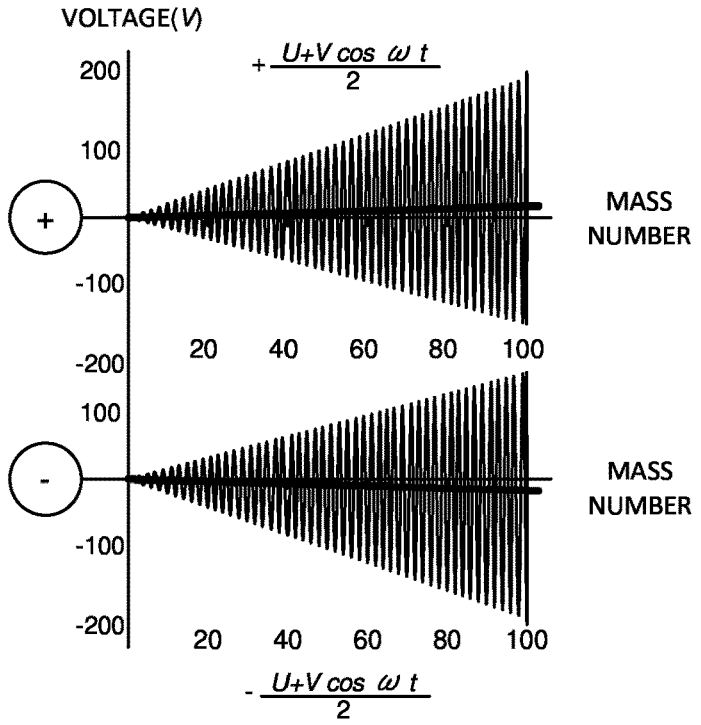
FIG. 2B illustrates a filter voltage that is applied to the quadrupole mass spectrometer according to the embodiment.

In the filter unit 3, a filter voltage of the same polarity is applied to each pair of opposing electrodes of the quadrupole 31 such that the voltage applied to each electrode is opposite in polarity to that to the next electrode. The filter voltage includes a DC voltage and an RF voltage as illustrated in FIG. 2A. For analysis, the amplitude of the DC voltage and that of the RF voltage are swept from a lower voltage to a higher voltage as illustrated in FIG. 2B. The filter voltage in the passing mode and that in the blocking mode will be described in detail later.

The detector 5 illustrated in FIGS. 2A and 3 is, for example, a Faraday cup, and generates a current based on the number of ions impinging on the detector.

Figure 4:
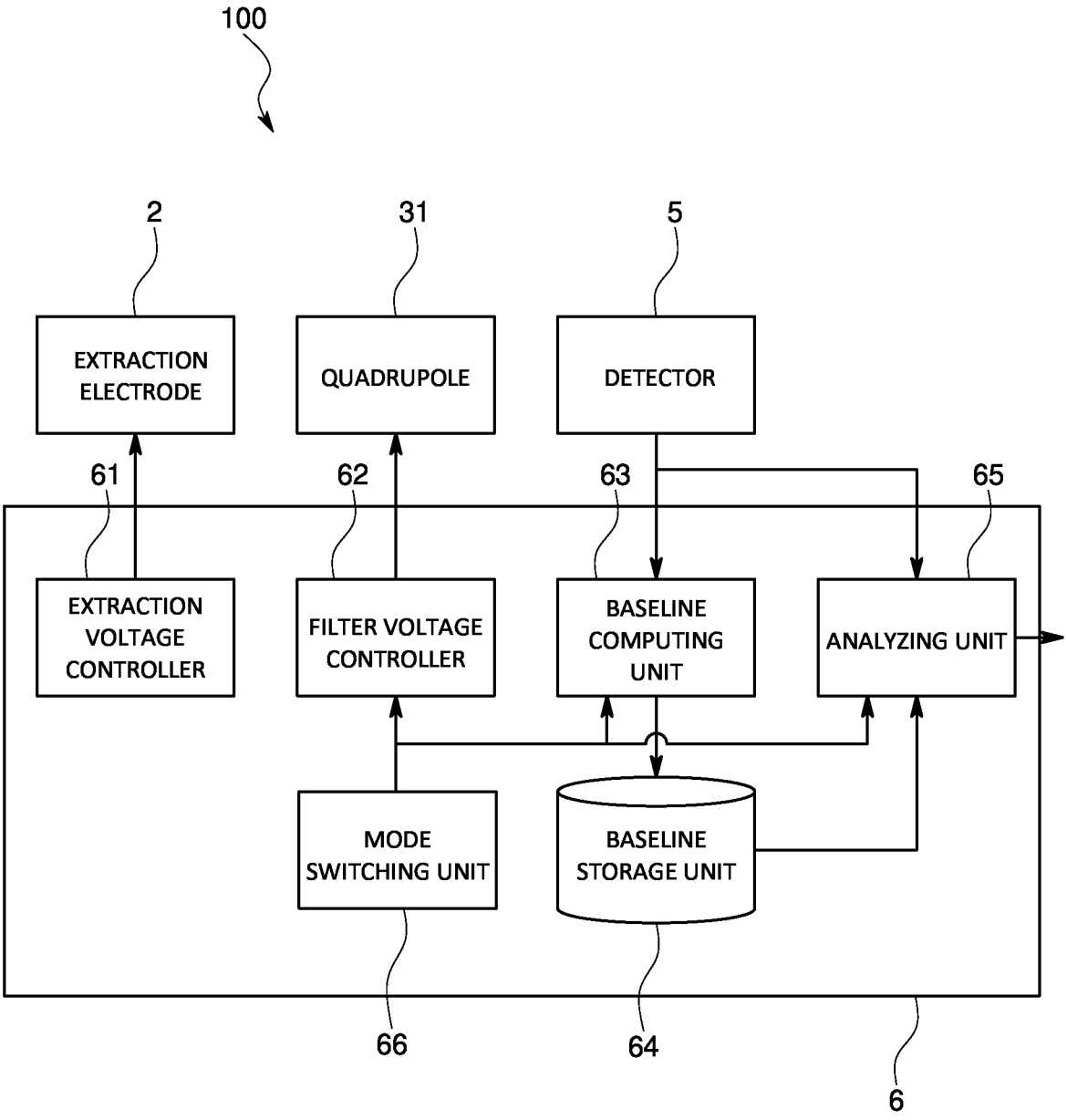
FIG. 4 is a functional block diagram illustrating an exemplary configuration of the quadrupole mass spectrometer according to the embodiment.

FIG. 4 illustrates the control computing mechanism 6, which includes a computer including an amplifier, an analog-to-digital (A/D) converter, a digital-to-analog (D/A) converter, a central processing unit (CPU), a memory, and a communication port. The control computing mechanism 6 performs mass analysis based on currents that are outputs of the detector 5, and transmits an analysis result to, for example, a general-purpose computer as necessary.

Specifically, the CPU executes a program for a quadrupole mass spectrometer stored in the memory and various devices cooperate with each other, causing the control computing mechanism 6 to function as at least an extraction voltage controller 61, a filter voltage controller 62, a baseline computing unit 63, a baseline storage unit 64, an analyzing unit 65, and a mode switching unit 66 illustrated in a functional block diagram of FIG. 4.

These controllers and units will now be described in detail.

The extraction voltage controller 61 controls a voltage that is applied to the extraction electrode 2. In the embodiment, as illustrated in a schematic diagram of FIG. 3, the extraction voltage controller 61 applies a voltage to the extraction electrode 2 such that the potential of the filter unit 3 is lower than that of the ion source 1. Note that a voltage is applied to the post-filter 4 such that the potential of the detector 5 is lower than that of the filter unit 3. The extraction voltage controller 61 is configured to maintain the difference in potential between the ion source 1 and the filter unit 3 constant in each of the passing mode and the blocking mode. In contrast, control in the related art is performed such that, for example, the potential of the filter unit 3 is higher than that of the ion source 1 in order to block ions from impinging on the detector 5.

As illustrated in FIG. 4, the filter voltage controller 62 controls a filter voltage that is applied to the quadrupole 31. Specifically, the filter voltage controller 62 applies a filter voltage (hereinafter, also referred to as a "passing filter voltage") to the quadrupole 31 in the passing mode so that ions travel in the filter unit 3 while oscillating stably and impinge on the detector 5. In contrast, in the blocking mode, the filter voltage controller 62 applies a filter voltage (hereinafter, also referred to as a "blocking filter voltage") to the quadrupole 31 so that ions travel along unstable trajectories in the filter unit 3 and strike the quadrupole 31 or move away from the detector 5, for example.

The passing filter voltage and the blocking filter voltage will now be described in detail with reference to FIGS. 5 and 6.

Figure 5:
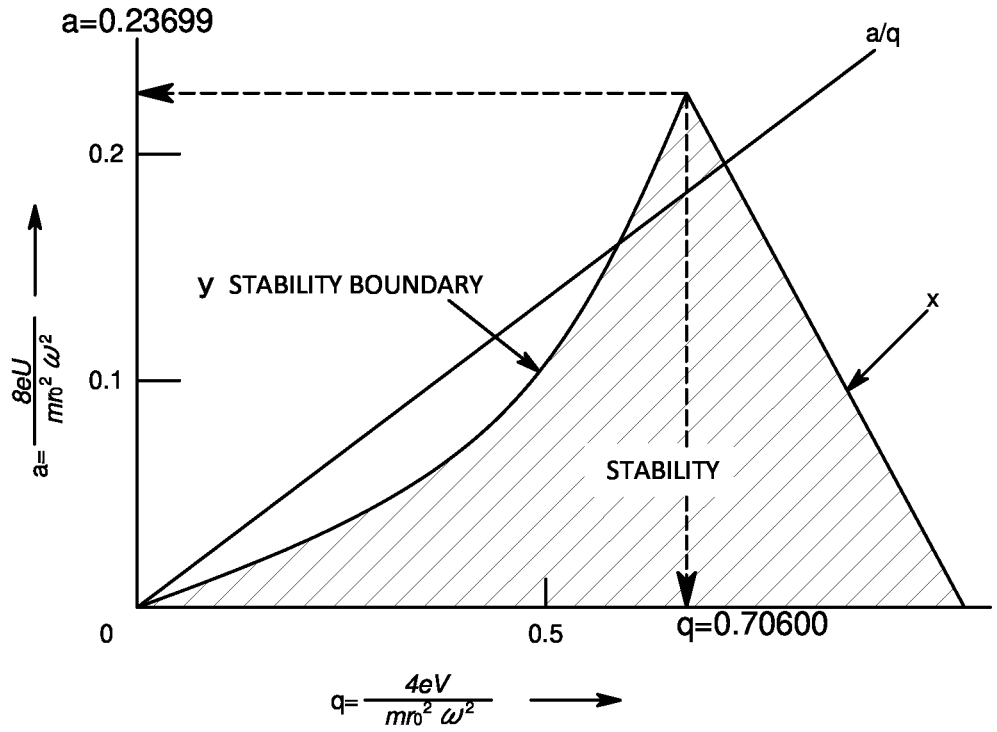
FIG. 5 is a schematic graph illustrating the relationship between the filter voltage and a stability region.
Figure 6:
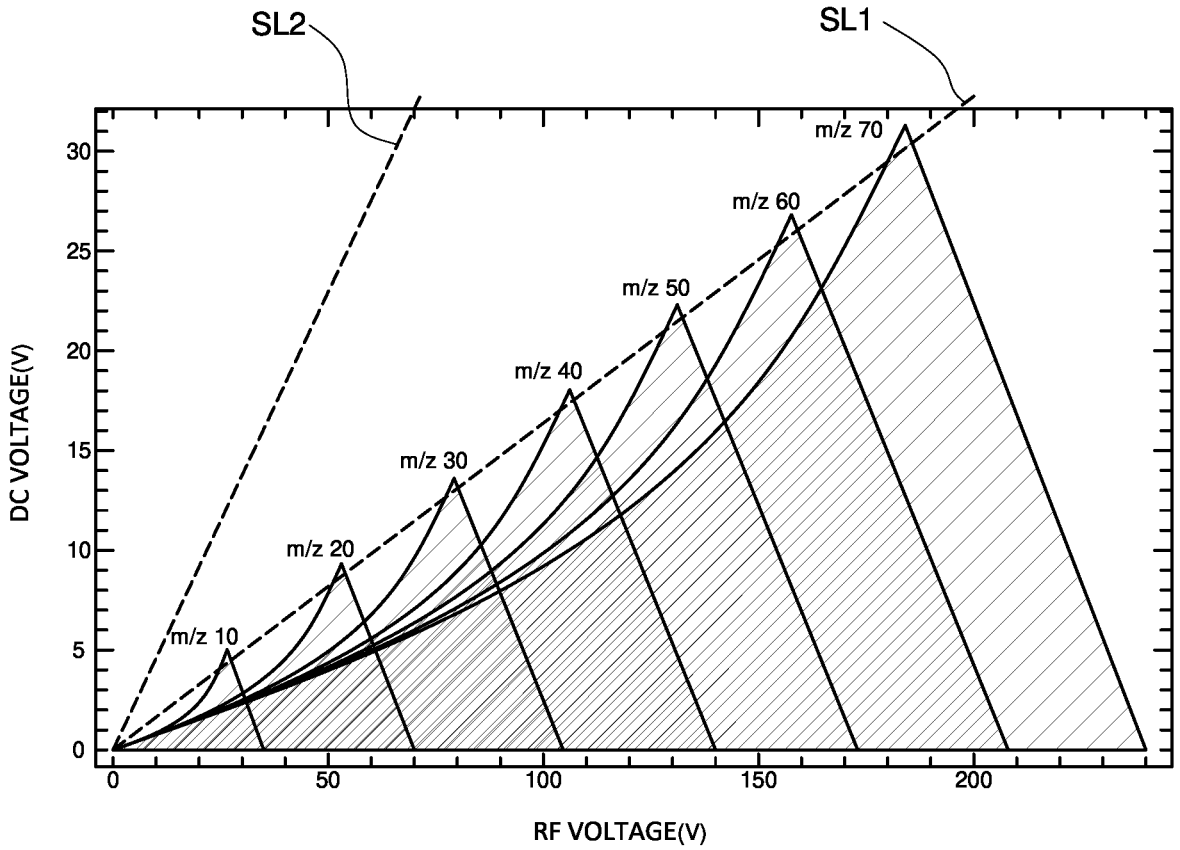
FIG. 6 is a schematic graph illustrating the relationship between scan lines for the filter voltage swept in a passing mode and a blocking mode and stability regions for mass-to-charge ratios in the embodiment.

The passing filter voltage that is applied to the quadrupole 31 in the passing mode is swept so as to pass through substantially triangular stability regions, which are hatched regions in FIGS. 5 and 6. The term "stability region" as used herein refers to a set of combinations of RF voltages and DC voltages allowing ions to pass through the filter unit 3 and reach the detector 5. The stability region is determined based on the Mathieu equation for each mass-to-charge ratio of ions to be analyzed. In the embodiment, the stability region is defined by the amplitude of a DC voltage and that of an RF voltage because the frequency of the RF voltage is fixed at a predetermined value. For actual analysis, the ratio of DC to RF voltages is set so that, when a certain passing filter voltage is applied to the quadrupole 31, ions of only one mass-to-charge ratio are allowed to impinge on the detector 5. Specifically, as illustrated in FIG. 6, the passing filter voltage is swept on a first scan line SL1, which is set so as to pass through portions of the stability regions that are near the apexes of the stability regions for mass-to-charge ratios. The term "apex of the stability region" as used herein refers to a point at which, of combinations of RF voltages and DC voltages allowing ions to impinge on the detector 5, the DC voltage is maximum relative to the RF voltage. The first scan line SL1 passes alternately through the stability regions and a region outside the stability regions. When the passing filter voltage is swept along the first scan line SL1, a period during which ions are detected and a period during which ions are not detected appear alternately. Furthermore, ions sequentially impinge on the detector 5 in order of increasing mass-to-charge ratio.

The blocking filter voltage that is applied to the quadrupole 31 in the blocking mode is swept along a second scan line SL2, which passes only through the region outside the stability regions. As illustrated in FIG. 6, the slope of the second scan line SL2 is set to be greater than that of the first scan line SL1. In other words, a DC voltage of the blocking filter voltage is set to be greater than a DC voltage of the passing filter voltage under conditions where these filter voltages include the same RF voltage.

Referring to FIG. 4, the baseline computing unit 63 computes a baseline based on outputs of the detector 5 that are obtained while the filter voltage controller 62 applies the blocking filter voltage to the quadrupole 31. For example, the baseline computing unit 63 computes, as a baseline, currents to be output when ions are not detected for each mass-to-charge ratio on the basis of the relationship between the mass-to-charge ratios, for each of which mass separation is achieved at an applied RF voltage when the passing filter voltage is applied, and data indicating the relationship between RF voltages and currents to be output from the detector 5 while the blocking filter voltage is swept along the second scan line SL2. FIG. 7A illustrates an example of a baseline. The computed baseline is stored in the baseline storage unit 64 and is used for computing in the analyzing unit 65.

The analyzing unit 65 outputs an analysis result of the sample based on the baseline and outputs of the detector 5 that are obtained while the filter voltage controller 62 applies the passing filter voltage to the quadrupole 31. The analyzing unit 65 computes the relationship between currents that are output from the detector 5 while the passing filter voltage is swept along the first scan line SL1 and the mass-to-charge ratios. FIG. 7B illustrates an example of this relationship. The analyzing unit 65 subtracts the baseline from the computed result to obtain a mass spectrum in which currents are substantially zero at mass-to-charge ratios other than mass-to-charge ratios to be analyzed. FIG. 7C illustrates this mass spectrum.

The mode switching unit 66 switches between operation modes of the filter voltage controller 62, the baseline computing unit 63, and the analyzing unit 65 in the passing mode and those in the blocking mode. In the embodiment, just after sample analysis is started, the mode switching unit 66 causes these components to operate in the blocking mode, and causes the baseline computing unit 63 to compute a baseline. Upon computation of the baseline, the mode switching unit 66 causes these components to operate in the passing mode, and causes the analyzing unit 65 to output a mass spectrum of a sample.

As described above, in the quadrupole mass spectrometer 100 according to the embodiment, in the blocking mode for baseline generation, the filter voltage controller 62 sweeps the blocking filter voltage applied to the quadrupole 31 along the second scan line SL2 so that the blocking filter voltage is deviated from all stability regions for the mass-to-charge ratios. This causes the electric field produced by the quadrupole 31 in the filter unit 3 to inhibit ions from traveling toward the detector 5. Thus, ions can be more reliably prevented from impinging on the detector 5 during baseline generation than in the related art. In other words, voltage conditions in the quadrupole mass spectrometer 100 in the blocking mode are set so that ions are allowed to enter the filter unit 3 and ions traveling from the filter unit 3 are not allowed to reach the detector 5. Setting these voltage conditions reduces the difference between a baseline for outputs of the detector 5 in the blocking mode and that in the passing mode.

This results in increased appropriateness of a baseline computed by the baseline computing unit 63, leading to improved reliability of a sample analysis result.

Other embodiments will now be described.

The quadrupole, which includes the four cylindrical electrodes in the foregoing embodiment, may have another configuration. In some embodiments, the quadrupole includes a cylinder having a hyperbolic inner surface.

The blocking filter voltage is not limited to that described in the foregoing embodiment. In other words, the blocking filter voltage is not limited to that swept along the second scan line, and may be swept along another straight line. The scan line along which the blocking filter voltage is swept can be set so as to pass only through the region outside the stability regions.

An application of the quadrupole mass spectrometer according to the present invention is not limited to use as a chamber residual gas analyzer. For example, the quadrupole mass spectrometer may be used together with, for example, a gas chromatograph, for sample quantitative analysis.

For the extraction electrode, a voltage applied to the extraction electrode is not changed in each of the passing mode and the blocking mode in the foregoing embodiment. In some embodiments, while the potential of the filter unit is higher than that of the ion source in the blocking mode, the blocking filter voltage is swept across the quadrupole. In some embodiments, while the blocking filter voltage is swept across the quadrupole, the potential of the detector is higher than that of the filter unit by using a voltage applied to the post-filter.

Furthermore, the embodiments of the present invention may be modified without departing from the spirit and scope of the present invention and parts of the embodiments may be combined.

What is claimed is:

1. A quadrupole mass spectrometer, comprising:

an ion source configured to ionize a sample;

a filter including a quadrupole, the filter being configured to separate ions generated from the ion source according to mass;

a detector configured to detect ions passing through the filter;

a filter voltage controller configured to control a filter voltage applied to the quadrupole to switch between (i) a blocking mode in which the filter voltage applied to the quadrupole is such that ions entering the filter are not allowed to impinge on the detector, and (ii) a passing mode in which the filter voltage applied to the quadrupole is such that ions entering the filter are allowed to impinge on the detector, the filter voltage comprising a radio-frequency (RF) voltage and a direct-current (DC) voltage;

a baseline computer configured to compute a baseline based on outputs of the detector in the blocking mode; and an analyzer configured to output an analysis result of the sample based on outputs of the detector in the passing mode and the baseline computed by the baseline computer, wherein the filter voltage controller is configured to sweep the filter voltage in the blocking mode such that the filter voltage passes outside all of one or more stability regions that are sets of combinations of RF and DC voltages allowing ions to pass through the filter unit and reach the detector.

2. The quadrupole mass spectrometer according to claim 1, wherein the filter voltage controller sweeps the filter voltage in the passing mode such that the filter voltage passes through at least one stability region that is a set of combinations of RF voltages and DC voltages allowing ions to pass through the filter and reach the detector.

3. The quadrupole mass spectrometer according to claim 2, wherein the at least one stability region comprises a plurality of stability regions determined for mass-to-charge ratios of ions, and wherein the filter voltage controller sweeps the filter voltage in the passing mode such that the filter voltage passes through apexes, at each of which the DC voltage is maximum relative to the RF voltage, of the stability regions or portions of the stability regions that are near the apexes.

4. The quadrupole mass spectrometer according to claim 2, wherein the at least one stability region comprises a plurality of stability regions determined for mass-to-charge ratios of ions.

5. The quadrupole mass spectrometer according to claim 1, wherein a slope of the DC voltage relative to the RF voltage of the filter voltage swept by the filter voltage controller in the blocking mode is set to be greater than a slope of the DC voltage relative to the RF voltage of the filter voltage swept by the filter voltage controller in the passing mode.

6. The quadrupole mass spectrometer according to claim 1, further comprising:

an ion injection electrode configured to produce an electric field that extracts ions from the ion source and causes the ions to enter the filter, wherein a voltage applied to the ion injection electrode in the passing mode is identical to a voltage applied to the ion injection electrode in the blocking mode.

7. A quadrupole mass spectrometry method for a quadrupole mass spectrometer that includes an ion source configured to ionize a sample, a filter including a quadrupole and configured to separate ions generated from the ion source according to mass, and a detector configured to detect ions passing through the filter, the method comprising:

controlling a filter voltage applied to the quadrupole to switch between (i) a blocking mode in which the filter voltage applied to the quadrupole is such that ions entering the filter are not allowed to impinge on the detector, and (ii) a passing mode in which the filter voltage applied to the quadrupole is such that ions entering the filter are allowed to impinge on the detector, the filter voltage comprising a radio-frequency (RF) voltage and a direct-current (DC) voltage;

computing a baseline based on outputs of the detector in the blocking mode; and outputting an analysis result of the sample based on outputs of the detector in the passing mode and the computed baseline computer, wherein the filter voltage controller is configured to sweep the filter voltage in the blocking mode such that the filter voltage passes outside all of one or more stability regions that are sets of combinations of RF and DC voltages allowing ions to pass through the filter unit and reach the detector.

8. A program storage medium storing a program for a quadrupole mass spectrometer that includes an ion source configured to ionize a sample, a filter including a quadrupole and configured to separate ions generated from the ion source according to mass, and a detector configured to detect ions passing through the filter, the program causing a computer to function as:

a filter voltage controller configured to control a filter voltage applied to the quadrupole to switch between (i) a blocking mode in which the filter voltage applied to the quadrupole is such that ions entering the filter are not allowed to impinge on the detector, and (ii) a passing mode in which the filter voltage applied to the quadrupole is such that ions entering the filter are allowed to impinge on the detector, the filter voltage comprising a radio-frequency (RF) voltage and a direct-current (DC) voltage;

a baseline computer configured to compute a baseline based on outputs of the detector in the blocking mode; and an analyzer configured to output an analysis result of the sample based on outputs of the detector in the passing mode and the baseline computed by the baseline computer, wherein the filter voltage controller is configured to sweep the filter voltage in the blocking mode such that the filter voltage passes outside all of one or more stability regions that are sets of combinations of RF and DC voltages allowing ions to pass through the filter unit and reach the detector.

9. A quadrupole mass spectrometer, comprising:

an ion source configured to ionize a sample;

a filter including a quadrupole, the filter being configured to separate ions generated from the ion source according to mass;

a detector configured to detect ions passing through the filter;

a filter voltage controller configured to control a filter voltage applied to the quadrupole to switch between (i) a blocking mode in which ions entering the filter are not allowed to impinge on the detector, and (ii) a passing mode in which ions entering the filter are allowed to impinge on the detector, the filter voltage comprising a radio-frequency (RF) voltage and a direct-current (DC) voltage;

a baseline computer configured to compute a baseline based on outputs of the detector in the blocking mode; and an analyzer configured to output an analysis result of the sample based on outputs of the detector in the passing mode and the baseline computed by the baseline computer, wherein the filter voltage controller is configured to sweep the filter voltage applied to the quadrupole in the passing mode such that the filter voltage passes through one or more stability regions, a stability region being a set of combinations of RF voltages and DC voltages allowing ions to pass through the filter unit and reach the detector, and the filter voltage controller is configured to sweep the filter voltage applied to the quadrupole in the blocking mode such that the filter voltage passes outside all of the one or more stability regions.

* * * * *